US012610982B2

(12) United States Patent
Blattler et al.

(10) Patent No.: US 12,610,982 B2
(45) Date of Patent: Apr. 28, 2026

(54) CARTRIDGE ASSEMBLY FOR AN AEROSOL-GENERATING SYSTEM HAVING LEAKAGE PREVENTION

(71) Applicant: Philip Morris Products S.A., Neuchatel (CH)

(72) Inventors: Olivier Blattler, Liebefeld-Berne (CH); Guillaume Frederick, Neuchatel (CH); Patrick Charles Silvestrini, Neuchatel (CH); Dominique Paul Gabriel Stohr, Liebefeld-Berne (CH)

(73) Assignee: Philip Morris Products S.A., Neuchatel (CH)

( * ) Notice: Subject to any disclaimer, the term of this patent is extended or adjusted under 35 U.S.C. 154(b) by 1080 days.

(21) Appl. No.: 17/312,745

(22) PCT Filed: Dec. 17, 2019

(86) PCT No.: PCT/EP2019/085744
§ 371 (c)(1),
(2) Date: Jun. 10, 2021

(87) PCT Pub. No.: WO2020/127338
PCT Pub. Date: Jun. 25, 2020

(65) Prior Publication Data

US 2022/0046988 A1 Feb. 17, 2022

(30) Foreign Application Priority Data

Dec. 17, 2018 (EP) ..... 18213174

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/46* (2020.01); *A24F 40/485* (2020.01)

(58) Field of Classification Search
None
See application file for complete search history.

(56) References Cited

U.S. PATENT DOCUMENTS

2013/0327327 A1 12/2013 Edwards et al.
2014/0334802 A1* 11/2014 Dubief ..... A61L 9/03 392/390
(Continued)

FOREIGN PATENT DOCUMENTS

CN 203692546 U 7/2014
CN 108463263 A 8/2018
(Continued)

OTHER PUBLICATIONS

WO2016159013A1 Description English Translation obtained from Espacenet, pp. 1-42 (Year: 2024).*
(Continued)

*Primary Examiner* — Philip Y Louie
*Assistant Examiner* — Virginia R Bieger
(74) *Attorney, Agent, or Firm* — Oblon, McClelland, Maier & Neustadt, L.L.P.

(57) ABSTRACT

A cartridge for an aerosol-generating system is provided, including a cartridge main body including a cartridge air outlet; a storage container within the body and containing a supply of liquid aerosol-forming substrate; a heating element disposed at a first end of the body and in fluid communication with the container; and a cartridge cap including a cartridge air inlet, a top portion to cover the first end of the body and the heating element, and a side portion extending from the top portion and over a part of a side
(Continued)

portion of the body and including an engagement portion to releaseably engage with a corresponding portion of the body, and, when the engagement portion is disengaged from the body, the cartridge cap is configured to move relative to the body between a first position, which blocks air from flowing, and a second position, in which an airflow path exists.

15 Claims, 7 Drawing Sheets

(51) Int. Cl.
*A24F 40/46* (2020.01)
*A24F 40/485* (2020.01)

(56) References Cited

U.S. PATENT DOCUMENTS

| | | | | |
|---|---|---|---|---|
| 2016/0120226 | A1* | 5/2016 | Rado | A24F 40/42 131/329 |
| 2016/0353801 | A1 | 12/2016 | Zinovik et al. | |
| 2017/0280773 | A1* | 10/2017 | Force | A24F 40/485 |
| 2017/0280774 | A1* | 10/2017 | Force | A24F 40/42 |
| 2017/0333650 | A1* | 11/2017 | Buchberger | A61M 11/044 |
| 2017/0340014 | A1 | 11/2017 | Batista et al. | |
| 2018/0127196 | A1 | 5/2018 | Edwards et al. | |
| 2018/0317558 | A1 | 11/2018 | Qiu | |
| 2019/0014825 | A1 | 1/2019 | Saygili | |
| 2019/0021399 | A1 | 1/2019 | Silvestrini | |

FOREIGN PATENT DOCUMENTS

| | | | | |
|---|---|---|---|---|
| KR | 10-2012-0115488 | | 10/2012 | |
| KR | 10-2016-0145838 | | 12/2016 | |
| RU | 2 617 297 | C2 | 4/2017 | |
| WO | WO 2013/184951 | A2 | 12/2013 | |
| WO | WO 2015/000974 | A1 | 1/2015 | |
| WO | WO-2016159013 | A1 * | 10/2016 | A24F 40/48 |
| WO | WO 2017/129616 | A1 | 8/2017 | |
| WO | WO 2017/129617 | A1 | 8/2017 | |
| WO | WO 2018/019485 | A1 | 2/2018 | |
| WO | WO 2019/081384 | A1 | 5/2019 | |

OTHER PUBLICATIONS

Combined Chinese Office Action and Search Report issued Dec. 24, 2024 in Chinese Patent Application No. 201980077380.X (with English Translation), 9 pages.

Extended European Search Report issued Jun. 19, 2019 in corresponding European Patent Application No. 18213174.8, 8 pages.

International Search Report and Written Opinion issued on Mar. 5, 2020 in PCT/EP2019/085744 filed on Dec. 17, 2019.

Combined Russian Office Action and Search Report issued Mar. 27, 2023, in corresponding Russian Patent Application No. 2021120014/03 (042019), (with English Translation), 11 pages.

Korean Notice of Allowance issued Jun. 25, 2025 in corresponding Korean Patent Application No. 2021-7016308, with English Translation, 5 pages.

* cited by examiner

CARTRIDGE ASSEMBLY FOR AN AEROSOL-GENERATING SYSTEM HAVING LEAKAGE PREVENTION

The invention relates to aerosol-generating systems, such as handheld electrically operated aerosol-generating systems. In particular the invention relates to cartridges for aerosol-generating systems, containing a supply of aerosol-forming substrate and a heater assembly.

Handheld electrically operated aerosol-generating systems that consist of a device portion comprising a battery and control electronics, and a cartridge portion comprising a supply of aerosol-forming substrate held in a storage portion and an electrically operated heater assembly acting as a vaporiser are known. A cartridge comprising both a supply of aerosol-forming substrate held in the storage portion and a vaporiser is sometimes referred to as a "cartomiser". The heater assembly may comprise a heating element that is either directly or indirectly in contact with the aerosol-forming substrate held in the storage portion. In some arrangements, the heating element is a fluid-permeable heating element and the liquid aerosol-forming substrate passes through pores or holes in the heating element so that the substrate can be vaporised.

Particularly when the cartridge comprises a liquid aerosol-forming substrate held in a storage portion, it may be desirable to control when said substrate is able to leave the storage portion. For example, it may be desirable to prevent migration of the substrate from the storage portion during transit or until a user is ready to use the cartridge. It may also be desirable to mitigate or prevent leakage of the substrate to the exterior of the cartridge.

Some prior art cartridges are therefore provided with one or more removable or frangible barriers, which can be removed or broken when a user is ready to use the cartridge. However, such arrangements may have a number of drawbacks. For example, once such a barrier has been removed or broken, it may not be possible to reseal the cartridge, and in particular to reseal the liquid aerosol-forming substrate in the storage portion of the cartridge. This may lead to subsequent leaking of liquid aerosol-forming substrate. This may interfere with the electrical components of the system, or cause inconvenience for the consumer, or both. Furthermore, such arrangements may be difficult for a consumer to handle, or difficult to manufacture, or both.

It would be desirable to provide a cartridge assembly that is more robust and less likely to leak. It would also be desirable to provide a cartridge assembly having a reusable housing.

According to a first aspect of the invention, there is provided a cartridge for an aerosol-generating system, the cartridge comprising: a cartridge main body; a storage container within the cartridge main body, the storage container containing a supply of liquid aerosol-forming substrate; a heating element disposed at a first end of the cartridge main body, the heating element being in fluid communication with the storage container; and a cartridge cap connected to and covering the first end of the cartridge main body. The cartridge cap comprises at least one cartridge air inlet, and the cartridge main body comprises at least one cartridge air outlet. The cartridge cap is configured to move relative to the cartridge main body between: a first position, in which one or both of the cartridge cap and the cartridge main body block air from flowing from the cartridge air inlet to the cartridge air outlet, via the heating element; and a second position, in which an airflow path exists from the cartridge air inlet to the cartridge air outlet, via the heating element. In some embodiments, both of the cartridge cap and the cartridge main body together act to block air from flowing from the cartridge air inlet to the cartridge air outlet. In particular, they may block air from flowing into the cartridge via the cartridge air inlet, by creating a sealed engagement at the cartridge air inlet. The sealed engagement may be formed by way of abutment between a surface of the cartridge cap and a surface of the cartridge main body, when the cartridge cap is in the first position. As described in more detail below, in some embodiments, the surface of the cartridge main body may be a surface of a heater assembly of the cartridge main body, such as a surface of a heater assembly cover of the cartridge main body.

In some embodiments of the first aspect of the invention, the cartridge comprises: a cartridge main body comprising at least one cartridge air outlet; a storage container within the cartridge main body, the storage container containing a supply of liquid aerosol-forming substrate; a heating element disposed at a first end of the cartridge main body, the heating element being in fluid communication with the storage container; and a cartridge cap comprising: at least one cartridge air inlet; a top portion configured to cover the first end of the cartridge main body and the heating element; and a side portion extending from the cartridge cap top portion and over a part of a side portion of the cartridge main body; and wherein, the cartridge cap side portion comprises an engagement portion, configured to releaseably engage with a corresponding portion of the cartridge main body, and wherein, when the engagement portion is disengaged from the cartridge main body the cartridge cap is configured to move relative to the cartridge main body between: a first position, in which one or both of the cartridge cap and the cartridge main body block air from flowing from the cartridge air inlet to the cartridge air outlet, via the heating element; and a second position, in which an airflow path exists from the cartridge air inlet to the cartridge air outlet, via the heating element.

By arranging for such a cartridge cap to be movable between the first and second positions, the airflow path across the heating element can be selectively opened and closed. A consumer can therefore select whether to have the airflow path open, for example when they wish to use the assembly in an aerosol-generating system; or whether to have the airflow path closed, for example when they do not wish to use the assembly in an aerosol-generating system. By arranging for the airflow path to be closed, when the assembly is not in use, the likelihood of accidental leakage of fluid from the assembly can be reduced. Furthermore, by arranging for the airflow path to be closed, when the assembly is not in use, unnecessary exposure of the heating element to external environmental conditions can be minimised.

The arrangement of the first aspect of the present invention can also allow for a cartridge to be supplied to a consumer in a condition in which the heating element and liquid aerosol-forming substrate are sealed and protected from the cartridge's external environment. This may help to better protect or preserve one or both of heating element and liquid aerosol-forming substrate.

The cartridge cap is configured to move between a first position and a second position. When the cartridge cap is in the first position, it can provide a sealed enclosure for the heating element. Consequently, when in the first position the cartridge cap can help to block air from flowing between the heating element and: the cartridge air inlet, a cartridge air outlet, or both. However, when the cartridge cap is in the second position, air can flow between the heating element and: the cartridge air inlet, the cartridge air outlet, or both. The cartridge cap can move between the first and second positions by way of a snap fit engagement between the cartridge cap and the cartridge main body. The at least one cartridge air inlet may be provided in the form of at least one opening in the cartridge cap. The at least one cartridge air outlet may be provided in the form of at least one opening in the main body of the cartridge.

As will be described in more detail below, according to a second aspect of the present invention, there is provided a cartridge assembly for an aerosol-generating system, the assembly comprising a cartridge, a housing configured to receive the cartridge. The cartridge comprises a cartridge main body; a storage container within the cartridge main body, the storage container containing a supply of liquid aerosol-forming substrate; a heating element disposed at a first end of the cartridge main body, the heating element being in fluid communication with the storage container; and a cartridge cap connected to and cover the first end of the cartridge main body. The cartridge cap comprises at least one cartridge air inlet, and the cartridge main body comprises at least one cartridge air outlet.

The housing has a mouth end and an opposed device end configured to connect to an aerosol-generating device, wherein at least one housing air outlet is provided at the mouth end of the housing, and at least one housing air inlet is provided upstream of the housing air outlet. The housing air inlet may be provided at the device end of the housing.

When the cartridge is disposed within the housing, the cartridge cap is configured to move relative to the cartridge main body between: a first position, in which one or both of the cartridge cap and the cartridge main body block air from flowing from the cartridge air inlet to the cartridge air outlet, via the heating element; and a second position, in which an airflow path exists from the cartridge air inlet to the cartridge air outlet, via the heating element. When the cartridge is removed from the housing, the cartridge cap is preferably configured to reside in the first position.

The arrangement of the second aspect of the invention advantageously means that the interior of the cartridge, and in particular, the interior region of the cartridge containing the heating element, is only exposed to external airflow when the cartridge has been inserted into the housing. This means that when the cartridge is being transported, handled, or both, the liquid aerosol-forming substrate is prevented from leaking from the cartridge. The present invention may therefore provide a more robust and reliable arrangement than prior art cartridge assemblies.

The cartridge may be removable from the housing. By arranging for the cartridge to be removable from the housing, it is possible to reuse the housing after disposing of the cartridge. In particular, when a supply of liquid aerosol-forming substrate has been fully consumed, the cartridge may be removed from the housing and discarded. The same housing may then be reused with a new cartridge.

The cartridge assembly of the second aspect of the invention may be supplied in a pre-assembled configuration. In this configuration, the cartridge is already disposed within the housing. In this configuration, the cartridge may be temporarily affixed to the housing to prevent accidental removal of the cartridge from the housing.

As an alternative to being supplied in a pre-assembled configuration, the cartridge assembly may be supplied in an unassembled configuration. In this case, the cartridge may be disposed outside of the housing but configured to be inserted into the housing, for example by a consumer. The cartridge may be configured to be inserted into the housing through an opening at the device end of the housing. Therefore, according to a third aspect of the invention, there is provided a kit for an aerosol-generating system, and in particular, a kit for a cartridge assembly for an aerosol-generating system. The kit comprises: a housing having a mouth end and an opposed device end configured to connect to an aerosol-generating device, wherein at least one housing air outlet is provided at the mouth end of the housing, and at least one housing air inlet is provided upstream of the housing air outlet; and a cartridge configured to be inserted into the housing. The cartridge comprises: the cartridge of the first aspect of the present invention.

The cartridge cap may comprise a top portion configured to overlie the end face of the first end of the cartridge main body; and a side portion extending from the cartridge cap top portion and over a part of a side portion of the cartridge main body. The cartridge cap top portion may be substantially planar. The cartridge cap top portion may be disc-like.

The cartridge cap side portion may comprise a side wall. The cartridge cap side wall may be a single wall, or may be a plurality of walls. Preferably, the cartridge side wall or side walls extend around and over the entire periphery of the side wall or walls at the first end of the cartridge main body. This may help to provide an effective seal at the first end of the cartridge body.

The cartridge cap side portion may comprise an engagement portion, which selectably engages with and disengages from a corresponding portion of the cartridge main body when the cartridge cap moves between the first position and the second position. For example, the cartridge cap side portion may comprise a deflectable member which is configured to releaseably engage with an engagement protrusion on the side wall of the cartridge main body. The deflectable member may extend directly from the cartridge cap top portion. The deflectable member may extend from a non-deflectable portion of the cartridge cap side wall. The deflectable member may have a distal end which extends towards a second end of the cartridge main body, and a proximal end attached to the rest of the cartridge cap. The second end of the cartridge main body may be opposed to the first end of the cartridge main body.

The deflectable member may comprise a hole or notch into which the engagement protrusion extends when the cartridge cap is in the first position. This can help to securely hold the cartridge cap in place with respect to the cartridge main body, when the cartridge cap is in the first position. To allow the cartridge cap to move to the second position, the deflectable member can be deflected away from the engagement protrusion, such that the engagement protrusion no longer extends into the hole or notch.

The cartridge cap top portion may comprise a pair of apertures arranged to overlie the heating element. Such apertures can advantageously allow electrical contacts on an electronic aerosol-generating device to form an electrical connection with the heating element. Preferably, each aperture in the pair of apertures is arranged to overly a corresponding end portion of the heating element. This may allow for electrical current to be passed across the heating element.

The heating element may be part of a heater assembly of the cartridge. The heater assembly may be disposed at the first end of the cartridge main body. The heater assembly may fill an opening at the first end of the cartridge main body. The heater assembly therefore underlies the cartridge cap. The opening may be an open end of the storage container within the cartridge main body.

The heater assembly may be the part of the cartridge main body, which contributes to blocking air from flowing from the cartridge air inlet to the cartridge air outlet, when the cartridge cap is in the first position. In particular, when the cartridge cap is in the first position, at least part of the heater assembly may be aligned with the cartridge air inlet, such that said at least part of the heater assembly occludes the cartridge air inlet and blocks air from flowing into the cartridge via the cartridge air inlet. For example, in the first position, an upper surface of the heater assembly may abut the lower surface of the cartridge cap. This may help to provide a sealed engagement to prevent air from flowing from the cartridge air inlet to the heating element.

The heater assembly may comprise a heater assembly base. The heater assembly base may be a portion of the heater assembly which fills the opening at the first end of the cartridge main body. The heater assembly base may comprise a hollow body with first and second heater assembly base openings, wherein the first heater assembly base opening is on an opposite end of the hollow body to the second heater assembly base opening. The heater assembly base may support the heating element. For example, the heating element may be mounted on the heater assembly base such that the heating element extends across the first heater assembly base opening.

A capillary material may be disposed in the hollow body of the heater assembly base. A liquid retention material for holding a liquid aerosol-forming substrate may be disposed in the hollow body of the heater assembly base. Where a capillary material and a liquid retention material are both provided, the capillary material may be positioned between the heating element and the liquid retention material.

The heater assembly may further comprise a heater assembly cover overlying the heater assembly base. The heater assembly cover may comprise a cover portion which generally overlies the heating element. The cover portion may be substantially planar. The cover portion may be disc-like.

The heater assembly cover may be the part of the cartridge main body, which contributes to blocking air from flowing from the cartridge air inlet to the cartridge air outlet, when the cartridge cap is in the first position. In particular, when the cartridge cap is in the first position, at least part of the heater assembly cover may be aligned with the cartridge air inlet, such that said at least part of the heater assembly cover occludes the cartridge air inlet and blocks air from flowing into the cartridge via the cartridge air inlet. For example, in the first position, an upper surface of the heater assembly cover may abut the lower surface of the cartridge cap. This may help to provide a sealed engagement to prevent air from flowing from the cartridge air inlet to the heating element. The heater assembly cover may have one or more portions configured to engage with the first end of the cartridge main body. For example, the heater assembly cover may comprise a pair of connecting arms extending from the cover portion of the heater assembly cover. The connecting arms may be configured to form a snap fit engagement with a respective corresponding portion of the outer surface of the first end of the cartridge main body. Each connecting arm may be substantially T-shaped. The corresponding portion of the outer surface of the first end of the cartridge main body may be in the form of a recess, which is shaped to correspond to the shape of a connecting arm of the heater assembly cover.

The heater assembly cover may comprise a first aperture overlying a central portion of the heating element. The first aperture may be square shaped. The first aperture may be centrally located on the heater assembly cover.

The heater assembly cover may comprise a pair of second apertures, each overlying an end portion of the heating element. The pair of second apertures may be circular shaped. The pair of second apertures on the heater assembly cover may be arranged to underlie a corresponding pair of apertures on the cartridge cap. Such an arrangement may allow for electrical contacts on an electronic aerosol-generating device to extend through the cartridge cap and the heater assembly cover and form an electrical connection with the heating element.

The heater assembly cover may comprise a third aperture positioned in a peripheral region of the heater assembly cover and not overlying the heating element. The third aperture is therefore not provided for interaction with the heating element. Instead, the third aperture may provide an exit point for airflow. In particular, when the cartridge cap is in the second position, an airflow chamber may be defined within the cartridge by a space existing between the cartridge cap and the heater assembly cover. In such a configuration, air can flow into the airflow chamber from the cartridge air inlet. The air may then flow across the top of the heater assembly cover and across the first aperture in the heater assembly cover, before it then exits the airflow chamber by way of the third aperture. Preferably, the first aperture of the heater assembly cover is positioned between a cartridge air inlet and the third aperture of the heater assembly cover. This can encourage airflow from the cartridge air inlet to pass via the first aperture of the outer heater, and thus the exposed portion of the heating element, before it reaches the exit point of the third aperture of the heater assembly cover. The third aperture may be arcuate shaped.

When the cartridge cap is in the first position, one or both of the cartridge cap and the cartridge main body may block air from flowing between the first aperture of the heater assembly cover and the third aperture of the heater assembly cover. For example, when the cartridge cap is in the first position the lower surface of the cartridge cap and the upper surface heater assembly cover may form a sealed engagement between the first and third apertures of the heater assembly cover. This may help to prevent liquid aerosol-forming substrate from leaking towards, and potentially out of, the cartridge air outlet.

The cartridge main body may be elongated. The cartridge main body may be substantially cylindrical. The cartridge main body may have a second end, opposed to the first end of the cartridge main body. The second end may be tapered.

The storage container may be formed from one or more distinct pieces, which are disposed within the cartridge main body. Alternatively, the storage container may be integrally formed within the cartridge main body. In this case, inner surfaces of the cartridge main body can define at least a portion of the boundary of the storage container. The cartridge main body and the storage container may be formed form a mouldable plastics material, such as polypropylene (PP) or polyethylene terephthalate (PET).

The cartridge main body may be formed as a single component. Alternatively, the cartridge main body may be formed of more than one component. For example, the cartridge main body may comprise two parts; a first part defining the storage container, and a second part configured to connect to the first part. The first and second parts of the cartridge main body may collectively define at least a portion of an airflow path in the cartridge. The least a portion of an airflow path in the cartridge may extend from the first end of the cartridge main body to a second, opposed end of the cartridge main body. This portion of the air flow path may be referred to as a side airflow path. The second part of the cartridge main body may attach to the first part of the cartridge main body by a snap fit engagement.

The second part of the cartridge main body may comprise a side cover portion arranged to extend along a side of the first part of the cartridge main body to define a side airflow channel, the side airflow channel being defined between the inner surface of the side cover portion and the outer surface of the first part of the cartridge main body, the side airflow channel forming part of the airflow path in the cartridge. The side cover portion may comprise a curved panel.

The second part of the cartridge main body may further comprise a nozzle portion attached to one end of the side cover portion, the nozzle portion defining a cartridge air outlet. The nozzle may be a hollow cone. The nozzle may have a first opening arranged to receive and engage with a distal end of the first part of the cartridge main body, and a second opening at the nozzle's distal end. The second opening of the nozzle may define a cartridge air outlet.

Where the cartridge main body has the side cover portion described above and the cartridge comprises the heater assembly cover described above with a third aperture, the cartridge is preferably arranged so that the third aperture of the heater assembly cover is disposed at one end of the side airflow channel. With this arrangement, air can exit the airflow chamber at the first end of the cartridge main body by way of the third aperture in the heater assembly cover, and then continue to flow through the cartridge, by way of the side airflow channel, until it eventually exits the cartridge by way of the cartridge air outlet in the nozzle.

The second aspect of the present invention provides for a cartridge assembly comprising a cartridge according to the first aspect of the invention and a housing for receiving the cartridge. The housing may provide the external surface of the cartridge assembly, when the cartridge assembly has been assembled. The housing may be intended to form a mouthpiece of an aerosol-generating device. The housing may be generally tubular. The is housing may have a device end configured to connect to a device portion of an aerosol-generating device, and an opposed mouth end configured for insertion into a user's mouth. A user may suck on the mouth end of the housing to draw aerosol generated in the cartridge into the user's mouth. The housing may have an opening at its device end for receiving a cartridge. The housing may have an opening at its mouth end for providing a housing air outlet.

The housing may comprise a connecting portion at its device end. The connecting portion may comprise a mechanical interlock structure, such as a snap fitting or a screw fitting, configured to engage a corresponding interlock structure on an aerosol-generating device. The interlock structure may permit at least some rotation of the housing relative to the device, but prevent axial movement of the housing relative to the device.

The housing and the cartridge are preferably arranged to engage with one another such that when the cartridge is received in the housing, rotational movement of the cartridge with respect to the housing causes longitudinal movement of the cartridge cap with respect to the cartridge main body. This longitudinal movement of the cartridge cap with respect to the cartridge main body corresponds to the movement of the cartridge cap relative to the cartridge main body between the first position and the second position. The first position may be regarded as a closed position because airflow is prevented, and the second position may be regarded as an open position because airflow is permitted.

Such an arrangement advantageously means that the cartridge cannot be easily opened until it is being used or about to be used. That is, such an arrangement can advantageously mean that the cartridge will not be easily opened during one or both of transport and storage. Instead, a user may only be able to open the cartridge, once they have inserted the cartridge into the housing. For example, once a user is ready to use the cartridge they insert it into the housing and apply forward rotation, such as clockwise rotation, in order to open the cartridge. When the user has finished using the cartridge and wish to close the cartridge and possibly remove the cartridge from the housing, the user applies reverse rotation, such as counter clockwise rotation, in order to close the cartridge and permit its removal from the housing.

To facilitate such an arrangement, in some embodiments the cartridge main body may comprise at least one guide protrusion, and the housing may provide a guide track for the at least one guide protrusion. The assembly may be configured so that the guide protrusion is received into the guide track when the cartridge is inserted into the housing. In particular, the housing may provide a receiving portion for permitting the guide protrusion to enter the guide track. The receiving portion may define a space through which the guide protrusion must pass before it can enter the guide track. This may help to ensure that the cartridge can only be fully inserted into the housing in one of a limited number of orientations, such as one or two pre-defined orientations.

The cartridge may be configured so that movement of the guide protrusion along the guide track of the housing is configured to cause movement of the cartridge cap with respect to the cartridge main body between the first attached position and the second partially attached position. For example, once received in the guide track, the cartridge assembly may be configured so that rotational movement of the cartridge with respect to the housing causes the guide protrusion to slide along the guide track. The guide track may be angled relative to the longitudinal axis of the housing, such that forward movement of the guide protrusion along the guide track causes the cartridge main body to be pulled further into the housing. The engagement between the cartridge and the housing is preferably configured to prevent the cartridge cap from also being pulled further into the housing when the guide protrusion is moving forward along the guide track.

Where the cartridge includes a mechanism for securely attaching the cartridge cap to the cartridge main body (such as the deflectable member and the engagement protrusion), the housing preferably includes a mechanism for temporarily disengaging such an attachment so that the cartridge cap is not pulled further into the housing with the cartridge main body. For example, the housing may further comprise a rim disposed within its interior, and the rim may be arranged to engage with the deflectable member of the cartridge main body as the cartridge is rotated within the housing. In particular, engagement of the rim with the deflectable member, may cause the deflectable member to disengage from the engagement protrusion of the cartridge main body. This can cause the cartridge cap to become temporarily detached from the cartridge main body, and thus allow the cartridge main body to be pulled further into the housing, without also pulling the cartridge cap further into the housing. This results in the cartridge main body moving longitudinally away from the cartridge cap, thus creating an airflow chamber within the cartridge between the underside of the cartridge cap and first end of the cartridge main body.

The edge of the rim of the housing may be angled, the edge of the deflectable member may be angled, or both. This may help to facilitate engagement of the rim with the deflectable member, and make it easier to lift the deflectable member away from its corresponding engagement protrusion.

When a user wishes to close the cartridge, remove the cartridge from the housing, or both, the user may apply a reverse rotation to the cartridge and housing so that the engagement protrusion of the cartridge main body moves in reverse along the guide track of the housing. The guide track may be configured so that such reverse movement causes the cartridge main body to be pushed towards the device end opening of the housing. This can cause the cartridge main body to move longitudinally towards the cartridge cap, and allow for disengagement of the rim from the deflectable member and reengagement of the engagement protrusion with the deflectable member. This can cause the cartridge to revert to its secured closed position.

The housing of the second aspect of the present invention may be provided as a single component. Alternatively, the housing may comprise two or more components.

Preferably, the housing comprises an outer housing and an insert member configured to be inserted into the outer housing. The insert member may be inserted through an opening at the device end of the outer housing. The insert member may fixed to an inner surface of the outer housing, for example, by a snap fit engagement. The insert member may be releasably fixed to the outer housing. The insert member may be permanently fixed to the outer housing. It will be appreciated that where preferred features are described below in respect of the insert member, such features may also be applicable to embodiments where the housing is a single component. That is, it will be appreciated that the insert member described below may be an integral part of the outer housing.

The insert member may advantageously enable cartridges in accordance with the present invention to connect to a range of different outer housings, including prior art outer housings. That is, the insert member may function as an adaptor so that cartridges in accordance with the present invention can connect to a range of different outer housings, including prior art outer housings. The insert member may be generally ring-shaped.

The combined use of an outer housing and an insert member in accordance with the second aspect of the present invention can advantageously allow for complex shapes to be formed in components of the assembly, whilst also allowing for efficient mass scale manufacturing of said components. This may be particularly beneficial when the housing comprises functional components designed to interact with the cartridge, such as the guide track, receiving portion and the rim.

Therefore, in some preferred embodiments, the rim of the housing is provided by the insert member. In some preferred embodiments, the receiving portion for the guide track of the housing is at least partially provided by the insert member.

In some preferred embodiments, at least a portion of the guide track of the housing is provided by the insert member. For example, the guide track may comprise a first or upper guide surface defined by the insert member and a second or lower guide surface defined by the outer housing. Each guide surface may comprise an inclined portion, and a non-inclined portion. Movement of the guide protrusion along a non-inclined portion does not cause longitudinal movement of the cartridge main body relative to the housing. On the other hand, movement of the guide protrusion along an inclined portion does cause longitudinal movement of the cartridge main body relative to the housing. The inclination is defined with respect to the longitudinal axis of the housing.

The housing may comprise a locking system, such as a bayonet locking system, for temporarily affixing the housing to a device portion of an aerosol-generating device. The locking system may restrict axial movement of the housing relative to the device portion, but permit at least some radial movement of the housing relative to the device portion. For example, when the housing is affixed to the device portion by the locking system, the housing may be free to rotate by up to 90 degrees, relative to the device portion. Such rotation occurs about the longitudinal axis of the housing.

The locking system may comprise a guide track in the outer surface of the device portion. A protrusion in the housing can be located in the guide track when the housing is first brought towards the device portion. A first portion of the guide track defines an axially extending strip along which the protrusion can slide as the housing is connected to the device portion. After sufficient axial movement of the housing towards the device portion, the protrusion reaches an end face of the first portion of the guide track. The end face may prevent further axial movement of the housing relative to the device portion. At this point, a second portion of the guide track extends laterally around the device portion, and therefore permits the housing to be rotated relative to the device portion. When the protrusion is located in the second portion of the guide track, the housing is prevented from moving axially relative to the device portion. This enables the housing to be temporarily fixed to the device portion, because it prevents axial separation of the housing and the device portion.

The cartridge cap may comprise a portion, such as a ridged portion, configured to engage with a corresponding surface on a device portion of an aerosol-generating device. Such an engagement may ensure that the cartridge becomes rotationally locked with respect to the device portion. This can mean that rotation of the device portion causes corresponding rotation of the cartridge. Put another way, if a housing is rotated relative to the device portion, then the engagement between device portion and the cartridge cap will also mean that the housing is rotated relative to the cartridge.

The heating element may be a fluid-permeable heating element. The heating element is in fluid communication with the supply of liquid aerosol-forming substrate held within the storage container of the cartridge main body. The heating element may be positioned across an opening in the storage container. The fluid-permeable heating element may be substantially flat. The heating element may be mounted on the heater cap such that the heating element extends across the first heater cap opening. The heater cap may be coupled to an open end of the storage container so that the heating element extends across the open end of the storage container. The heating element may be part of a heater assembly in the cartridge. The heater assembly may comprise electrical contact pads connected to the heating element.

As used herein, "electrically conductive" means formed from a material having a resistivity of 1×10−4 Ohm meter, or less. As used herein, "electrically insulating" means formed from a material having a resistivity of 1×104 Ohm meter or more. As used herein, "fluid-permeable" in relation to a heater assembly means that the aerosol-forming substrate, in a gaseous phase and possibly in a liquid phase, can readily pass through the heating element of the heater assembly.

The heater assembly may comprise a substantially flat heating element to allow for simple manufacture. Geometrically, the term "substantially flat" electrically conductive heating element is used to refer to an electrically conductive arrangement of filaments that is in the form of a substantially two dimensional topological manifold. Thus, the substantially flat electrically conductive heating element extends in two dimensions along a surface substantially more than in a third dimension. In particular, the dimensions of the substantially flat heating element in the two dimensions within the surface is at least five times larger than in the third dimension, normal to the surface. An example of a substantially flat heating element is a structure between two substantially imaginary parallel surfaces, wherein the distance between these two imaginary surfaces is substantially smaller than the extension within the surfaces. In some embodiments, the substantially flat heating element is planar. In other embodiments, the substantially flat heating element is curved along one or more dimensions, for example forming a dome shape or bridge shape.

The term "filament" is used throughout the specification to refer to an electrical path arranged between two electrical contacts. A filament may arbitrarily branch off and diverge into several paths or filaments, respectively, or may converge from several electrical paths into one path. A filament may have a round, square, flat or any other form of cross-section. A filament may be arranged in a straight or curved manner.

The heating element may be an array of filaments, for example arranged parallel to each other. Preferably, the filaments may form a mesh. The mesh may be woven or non-woven. The mesh may be formed using different types of weave or lattice structures. Alternatively, the electrically conductive heating element consists of an array of filaments or a fabric of filaments. The mesh, array or fabric of electrically conductive filaments may also be characterized by its ability to retain liquid.

In a preferred embodiment, a substantially flat heating element may be constructed from a wire that is formed into a wire mesh. Preferably, the mesh has a plain weave design. Preferably, the heating element is a wire grill made from a mesh strip.

The electrically conductive filaments may define interstices between the filaments and the interstices may have a width of between 10 micrometres and 100 micrometres. Preferably, the filaments give rise to capillary action in the interstices, so that in use, liquid to be vaporized is drawn into the interstices, increasing the contact area between the heating element and the liquid aerosol-forming substrate.

The electrically conductive filaments may form a mesh of size between 60 and 240 filaments per centimetre (+/−10 percent). Preferably, the mesh density is between 100 and 140 filaments per centimetres (+/−10 percent). More preferably, the mesh density is approximately 115 filaments per centimetre. The width of the interstices may be between 100 micrometres and 25 micrometres, preferably between 80 micrometres and 70 micrometres, more preferably approximately 74 micrometres. The percentage of open area of the mesh, which is the ratio of the area of the interstices to the total area of the mesh may be between 40 percent and 90 percent, preferably between 85 percent and 80 percent, more preferably approximately 82 percent.

The electrically conductive filaments may have a diameter of between 8 micrometres and 100 micrometres, preferably between 10 micrometres and 50 micrometres, more preferably between 12 micrometres and 25 micrometres, and most preferably approximately 16 micrometres. The filaments may have a round cross section or may have a flattened cross-section.

The area of the mesh, array or fabric of electrically conductive filaments may be small, for example less than or equal to 50 square millimetres, preferably less than or equal to 25 square millimetres, more preferably approximately 15 square millimetres. The size is chosen such to incorporate the heating element into a handheld system. Sizing of the mesh, array or fabric of electrically conductive filaments less or equal than 50 square millimetres reduces the amount of total power required to heat the mesh, array or fabric of electrically conductive filaments while still ensuring sufficient contact of the mesh, array or fabric of electrically conductive filaments to the liquid aerosol-forming substrate. The mesh, array or fabric of electrically conductive filaments may, for example, be rectangular and have a length between 2 millimetres to 10 millimetres and a width between 2 millimetres and 10 millimetres. Preferably, the mesh has dimensions of approximately 5 millimetres by 3 millimetres.

The filaments of the heating element may be formed from any material with suitable electrical properties. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group.

Examples of suitable metal alloys include stainless steel, constantan, nickel-, cobalt-, chromium-, aluminum-, titanium-, zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminum based alloys and iron-manganese-aluminum based alloys. Timetal® is a registered trade mark of Titanium Metals Corporation. The filaments may be coated with one or more insulators. Preferred materials for the electrically conductive filaments are stainless steel and graphite, more preferably 300 series stainless steel like AISI 304, 316, 304L, 316L. Additionally, the electrically conductive heating element may comprise combinations of the above materials. A combination of materials may be used to improve the control of the resistance of the substantially flat heating element. For example, materials with a high intrinsic resistance may be combined with materials with a low intrinsic resistance. This may be advantageous if one of the materials is more beneficial from other perspectives, for example price, machinability or other physical and chemical parameters. Advantageously, a substantially flat filament arrangement with increased resistance reduces parasitic losses. Advantageously, high resistivity heaters allow more efficient use of battery energy.

Preferably, the filaments are made of wire. More preferably, the wire is made of metal, most preferably made of stainless steel.

The electrical resistance of the mesh, array or fabric of electrically conductive filaments of the heating element may be between 0.3 Ohms and 4 Ohms. Preferably, the electrical resistance is equal or greater than 0.5 Ohms. More preferably, the electrical resistance of the mesh, array or fabric of electrically conductive filaments is between 0.6 Ohms and 0.8 Ohms, and most preferably about 0.68 Ohms. The electrical resistance of the mesh, array or fabric of electrically conductive filaments is preferably at least an order of magnitude, and more preferably at least two orders of magnitude, greater than the electrical resistance of electrically conductive contact areas. This ensures that the heat generated by passing current through the heating element is localized to the mesh or array of electrically conductive filaments. It is advantageous to have a low overall resistance for the heating element if the system is powered by a battery. A low resistance, high current system allows for the delivery of high power to the heating element. This allows the heating element to heat the electrically conductive filaments to a desired temperature quickly.

The storage container of the cartridge main body may contain a liquid retention material for holding a liquid aerosol-forming substrate. The liquid retention material may be a foam, and sponge of collection of fibres. The liquid retention material may be formed from a polymer or copolymer. In one embodiment, the liquid retention material is a spun polymer.

Preferably, the storage container holds a capillary material for transporting liquid aerosol-forming substrate to the heating element. The capillary material may be provided in contact with the heating element. Preferably, the capillary material is arranged between the heating element and the retention material.

The capillary material may be made of a material capable of guaranteeing that there is liquid aerosol-forming substrate in contact with at least a portion of the surface of the heating element. The capillary material may extend into interstices between the filaments. The heating element may draw liquid aerosol-forming substrate into the interstices by capillary action.

A capillary material is a material that actively conveys liquid from one end of the material to another. The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid aerosol-forming substrate towards the heating element. Alternatively, the capillary material may comprise sponge-like or foam-like material. The structure of the capillary material forms a plurality of small bores or tubes, through which the liquid aerosol-forming substrate can be transported by capillary action. The capillary material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid aerosol-forming substrate has physical properties, including but not limited to viscosity, surface tension, density, thermal conductivity, boiling point and vapour pressure, which allow the liquid aerosol-forming substrate to be transported through the capillary medium by capillary action.

The aerosol-forming substrate is a substrate capable of releasing volatile compounds that can form an aerosol. The volatile compounds may be released by heating the aerosol-forming substrate.

The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenized plant-based material. The aerosol-forming substrate may comprise homogenized tobacco material. The aerosol-forming substrate may comprise at least one aerosol-former. The aerosol-forming substrate may comprise other additives and ingredients, such as flavourants.

The heating element may have at least two electrically conductive contact pads. The electrically conductive contact pads may be positioned at an edge area of the heating element. Preferably, the at least two electrically conductive contact pads may be positioned on extremities of the heating element. An electrically conductive contact pad may be fixed directly to the electrically conductive filaments. An electrically conductive contact pad may comprise a tin patch. Alternatively, an electrically conductive contact pad may be integral with the electrically conductive filaments.

The cartridge may be a disposable article to be replaced with a new cartridge once the liquid storage portion of the cartridge is empty or the amount of liquid in the cartridge is below a minimum volume threshold. Preferably, the cartridge is pre-loaded with liquid aerosol-forming substrate.

According to a fourth aspect of the invention, there is provided an aerosol-generating system comprising a cartridge or cartridge assembly in accordance with the first or second aspects of the invention and an aerosol-generating device comprising a power supply and control electronics, wherein the cartridge or cartridge assembly is configured to connect to the aerosol-generating device. When the cartridge or cartridge assembly is connected to the aerosol-generating device, the heating element may be electrically connected to the power supply.

The aerosol-generating device may comprise a connecting portion for engagement with a corresponding connecting portion on the cartridge or cartridge assembly.

The aerosol-generating device may comprise at least one electrical contact element configured to provide an electrical connection to the heating element when the aerosol-generating device is connected to the cartridge assembly. The electrical contact element may be elongate. The electrical contact element may be spring-loaded. The electrical contact element may contact an electrical contact pad in the cartridge assembly.

The power supply is advantageously a battery, such as a lithium ion battery. As an alternative, the power supply may be another form of charge storage device such as a capacitor. The power supply may require recharging. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the heater assembly.

The control electronics may comprise a microcontroller. The microcontroller is preferably a programmable microcontroller. The electric circuitry may comprise further electronic components. The electric circuitry may be configured to regulate a supply of power to the heater assembly. Power may be supplied to the heater assembly continuously following activation of the system or may be supplied intermittently, such as on a puff-by-puff basis. The power may be supplied to the heater assembly in the form of pulses of electrical current.

Preferably, the aerosol-generating system is a handheld system. Preferably, the aerosol-generating system is portable. The aerosol-generating system may have a size comparable to a conventional cigar or cigarette. The aerosol-generating device system may have a total length between approximately 30 millimetres and approximately 150 millimetres. The aerosol-generating device system may have an external diameter between approximately 5 millimetres and approximately 30 millimetres.

The terms "upstream" and "downstream" refer to relative positions of elements of the cartridge or cartridge assembly described in relation to the direction of the flow of air or aerosol as it is drawn through the cartridge or cartridge assembly. The most upstream point is therefore the point at which air initially enters the cartridge or cartridge assembly. The most downstream point is the point at which air or aerosol terminally exits the cartridge or cartridge assembly.

It will be appreciated that preferred features described above in relation to one aspect of the invention may also be applicable to other aspects of the invention.

Embodiments of the invention will now be described, by way of example only, with reference to the accompanying drawings, in which.

Figure 1:
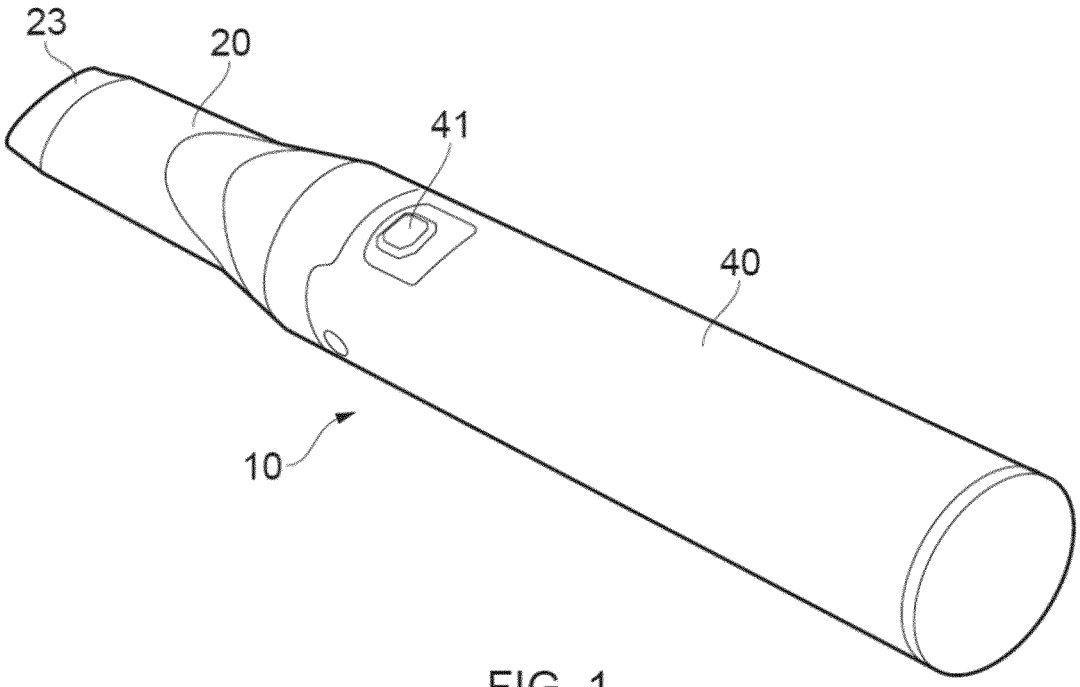
FIG. 1 shows perspective view of an aerosol-generating system having a prior art cartridge assembly and an aerosol-generating device.

FIG. 1 is a perspective view of an aerosol-generating system 10 comprising a prior art cartridge assembly 20, and an aerosol-generating device 40 that are coupled together.

Figure 2:
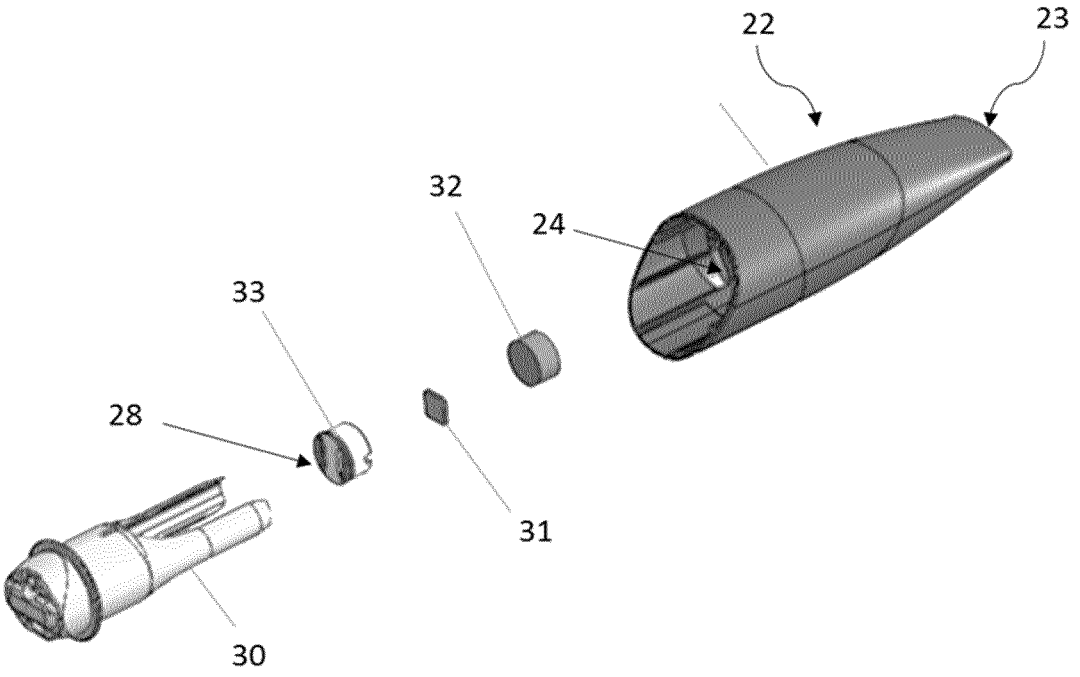
FIG. 2 shows an exploded perspective view of the cartridge assembly of FIG. 1.

FIG. 2 is an exploded view of the prior art cartridge assembly 20 shown in FIG. 1. The cartridge assembly 20 comprises a housing 22, which forms a mouthpiece for the system. Within the housing there is a storage container 24 holding liquid aerosol-forming substrate 26. The storage container 24 is open at the device end. A heater assembly comprising a flat liquid permeable mesh heating element 28 held onto a heater cap 33, is arranged to cover the open device end of the storage container 24. A liquid retention 32 material is positioned within the cap. A capillary material 31 is positioned between the heater assembly and the retention material 32. A protective cover or cap 30 is fitted to the housing to retain the heater assembly in a fixed position relative to the storage container 24. The protective cover also covers the heating element 28 and protects it from damage.

Figure 3:
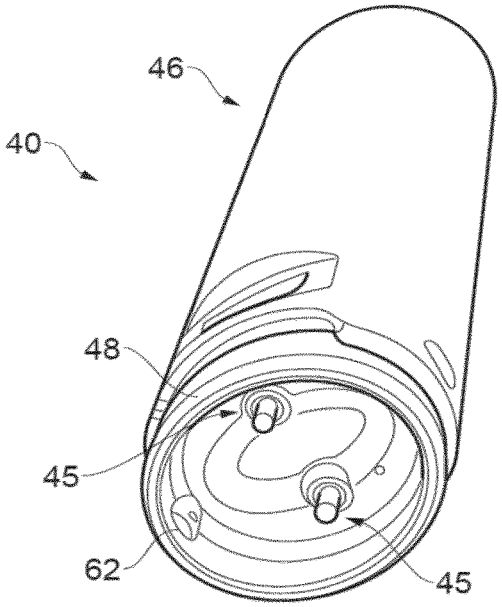
FIG. 3 shows a perspective view of the device of FIG. 1.

FIG. 3 is a perspective view of an aerosol-generating device 40. The device 40 comprises a housing 46, holding a power supply, in the form of a lithium ion battery and control circuitry. The device also comprises spring loaded electrical contact elements 45, configured to contact electrical contact pads on the heater assembly in the cartridge. In the specific example of FIG. 3, the electrical contact elements 45 are in the form of pogo pins. However, it will be appreciated that other forms of contact elements are also contemplated within this disclosure. The contact elements 45 are electrically coupled to the power supply, so that when the cartridge assembly 20 is connected to the device 40, electrical power can be supplied to the mesh heating element 28 in the cartridge assembly 20.

A button 41 is provided, that actuates a switch in the control circuitry to activate the device. When the device is activated, the control circuitry supplies power from the battery to the heater in the cartridge. The control circuitry may be configured to control the supply of power to the heater after activation in many different ways, as is known in the art. For example, the control circuitry may be configured to control the power supplied to the heater based on one or more of: a temperature of the heater, a detected airflow through the system, a time following activation, a determined or estimated liquid amount in the cartridge, an identity of the cartridge and ambient conditions.

The cartridge 20 and device 40 are arranged to couple to one another, for example, by a push fitting. The cartridge housing 22 is shaped to allow it to couple to the device 40 in only two orientations, ensuring that spring loaded electrical contact elements 45 can contact the contact pads of the heater assembly via openings in the protective cover 30 of the cartridge 24. A connecting rib 48 of the device portion engages a recess on the housing 22 to retain the cartridge and device portion together.

Figure 4:
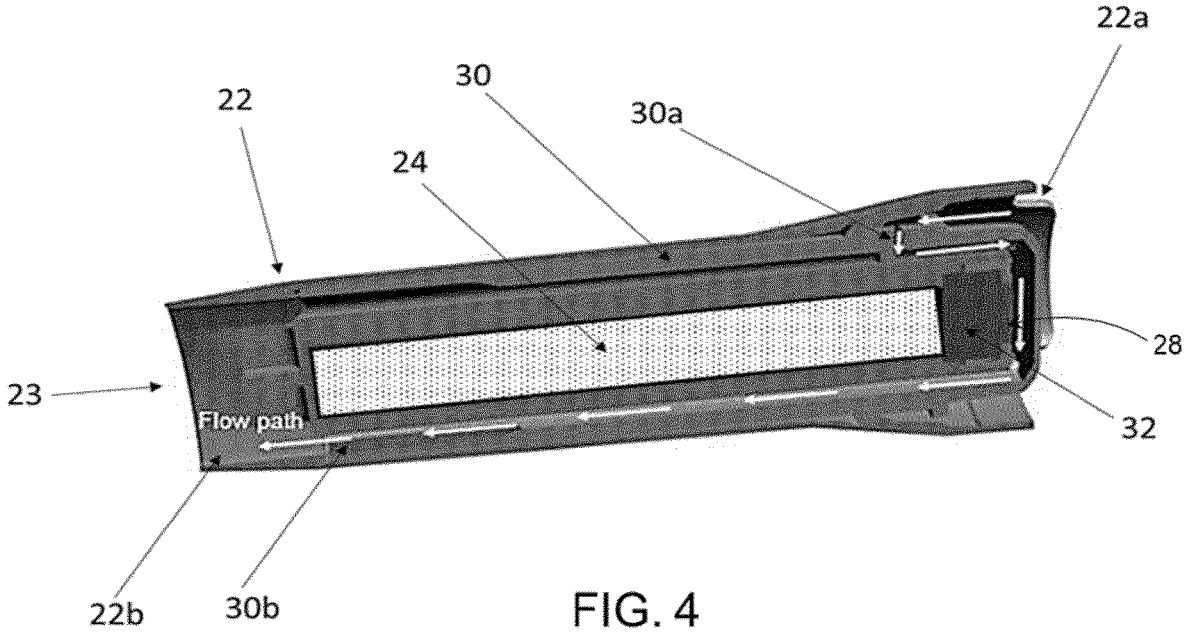
FIG. 4 shows a sectional view of the cartridge assembly of FIG. 1.

As best seen from FIG. 4, the prior art cartridge assembly 20 comprises a supply of liquid aerosol-forming substrate 24 and heater assembly. The device functions to supply electrical power to the heater assembly in the prior art cartridge assembly 20 in order to vaporise the liquid aerosol-forming substrate. The vaporised aerosol-forming substrate is entrained in an airflow through the system, the airflow resulting from a user puffing on a mouthpiece 23 of the prior art cartridge assembly 20. The vaporised aerosol-forming substrate cools in the airflow to form an aerosol before being drawn into a user's mouth.

The airflow path in FIG. 4 is illustrated by arrows. In particular, when a user draws on the mouth end 23 of the housing 22, air is drawn into the cartridge assembly at an upstream housing air inlet 22*a*. The air then passes through an air inlet 30*a* in the protective cap 30, and past the liquid permeable heating element 28. The vaporised aerosol-forming substrate is then drawn by the air along the flow path and through an air outlet 30*b* in the protective cap 30, before finally exiting the assembly 20 at a housing air outlet 22*b* at the mouth end 23 of the housing 22. In this prior art arrangement there is a possibility of liquid leaking out of the cartridge assembly 20 through one or both of housing air inlet 22*a* and housing air outlet 22*b*.

FIGS. 5 to 12B show various views of a cartridge and a cartridge assembly according to an embodiment of the present invention.

Figure 5:
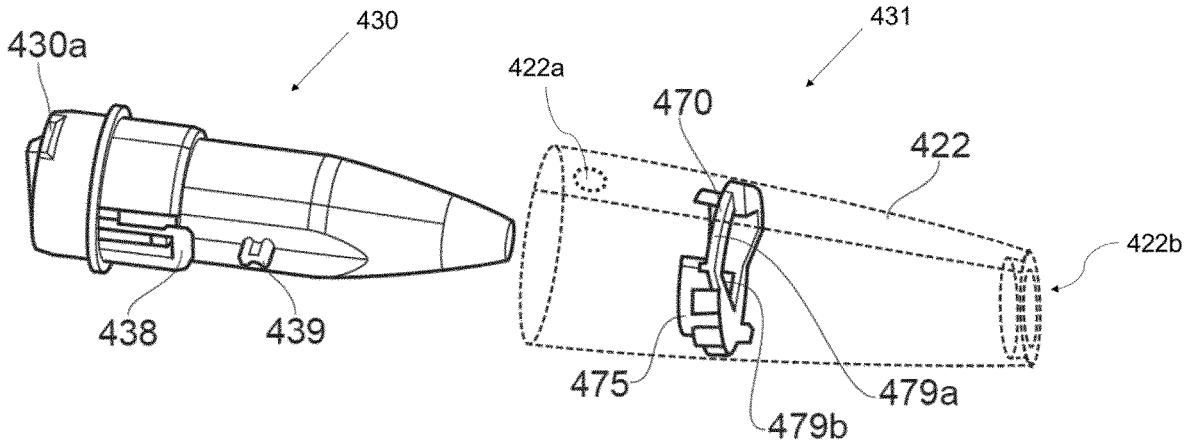
FIG. 5 shows an exploded perspective view of a cartridge assembly according to a first embodiment of the present invention.

Starting with FIG. 5, there can be seen a cartridge assembly comprising a cartridge 430 and a cartridge housing 431. The cartridge housing 431 comprises an outer housing 422 and an insert member 470 configured to be inserted into the outer housing 422 through an open end of the outer housing 422. The outer housing 422 has an outer housing air inlet 422*a* and an outer housing air outlet 422*b*. The insert member 470 is generally ring-shaped and is configured to form a snap fit engagement with a portion of the inner surface of the outer housing 422, when the insert member 470 is inserted into the outer housing 422. The insert member 470 may advantageously allow the cartridge 430 to be used with an existing outer housing or legacy outer housing design. That is, the insert member 470 may be advantageously used to adapt an existing outer housing or legacy outer housing design for use with the cartridge 430. Furthermore, the adoption of a two-piece arrangement with the outer housing 422 and insert member 470 may advantageously allow for more complexly shaped features, such as a guide track (as will be described below) to be formed using efficient manufacturing techniques, such as cast moulding, for example. Although the insert member 470 and the outer housing 422 are described as a two-piece arrangement in this specific embodiment, it will be appreciated that they could instead be provided integral with one another so that the cartridge housing 431 only consisted of a single component.

Figure 6:
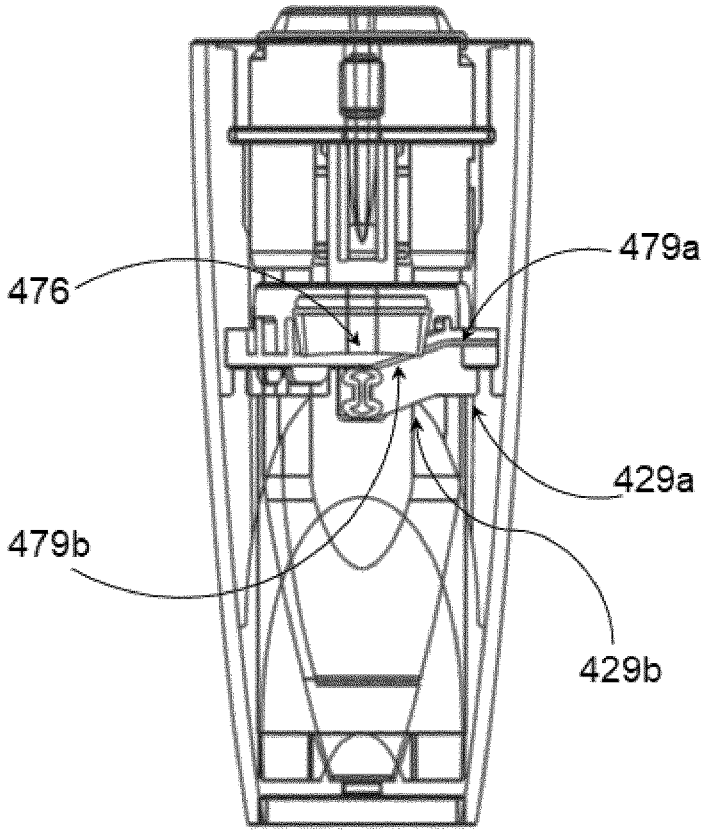
FIG. 6 shows a partially-transparent view of the cartridge assembly of FIG. 5.

As best seen from FIG. 6, the insert member 470 and the outer housing 422 together define a guide track suitable for receiving a guide protrusion 439 of a cartridge 430, when said cartridge 430 is received in the cartridge housing 431. The guide track comprises a first or upper guide surface 479 defined by the insert member 470 and a second or lower guide surface 429 defined by the outer housing 422. Each guide surface comprises at least one non-inclined portion 429*a*, 479*a* that resides entirely within a plane which extends substantially perpendicular to the longitudinal axis of the outer housing 422. Each guide surface also comprises an inclined portion 429*b*, 479*b* that extends at an angle relative to the plane which is substantially perpendicular to the longitudinal axis of the outer housing 422. As will be described in more detail below, the inclined portion 429*b*, 479*b* of the guide surfaces is configured to engage with the guide protrusion 439 of the cartridge to facilitate movement of the cartridge between the first, closed state and the second, open state.

In order to allow the guide protrusion 439 of a cartridge 430 to be received into the guide track, the insert member 470 comprises a receiving portion 476, which extends radially outward from the guide track portion of the insert member 470 to define a space for passage of the cartridge's guide protrusion 439.

The insert member 470 further comprises a rim 475 extending away from the portion of the insert member comprising the guide surface 479. When the insert member 470 is inserted into the outer housing 422, the rim 475 extends towards the device end of the outer housing 422. As will be described in more detail below, when the cartridge 430 is inserted into the outer housing 422, the rim 475 of the insert member 470 is configured to engage with a deflectable member 438 of the cartridge 430 to facilitate movement of the cartridge 430 between the first, closed state and the second, open state.

Figure 7:
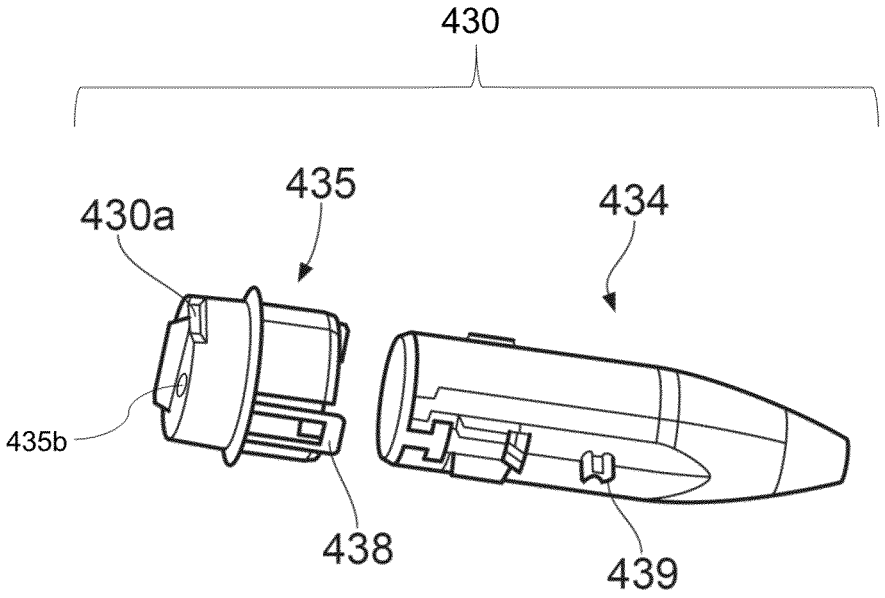
FIG. 7 shows an exploded perspective view of a cartridge according to a first embodiment of the present invention.

As shown in FIG. 7, the cartridge 430 comprises a cartridge main body 434 and a cartridge cap 435 configured to connect to and cover a first end of the cartridge main body 434. The cartridge 430 also comprises a heater assembly 133, which is disposed at the first end of the cartridge main body 434, and underlies the cartridge cap 435. In particular, the cartridge main body 434 has a hollow interior portion, which forms a storage container 424 for holding liquid aerosol-forming substrate. The storage container 424 has an opening at the first end of the cartridge main body 434, which is filled by the heater assembly 133.

The heater assembly 133 comprising a flat liquid permeable mesh heating element 128 held onto a heater assembly base 433. The heater assembly 133 also comprises a liquid retention material 32 positioned within the heater assembly base 433. A capillary material may be positioned between heating element 128 and the retention material 32.

Figure 8:
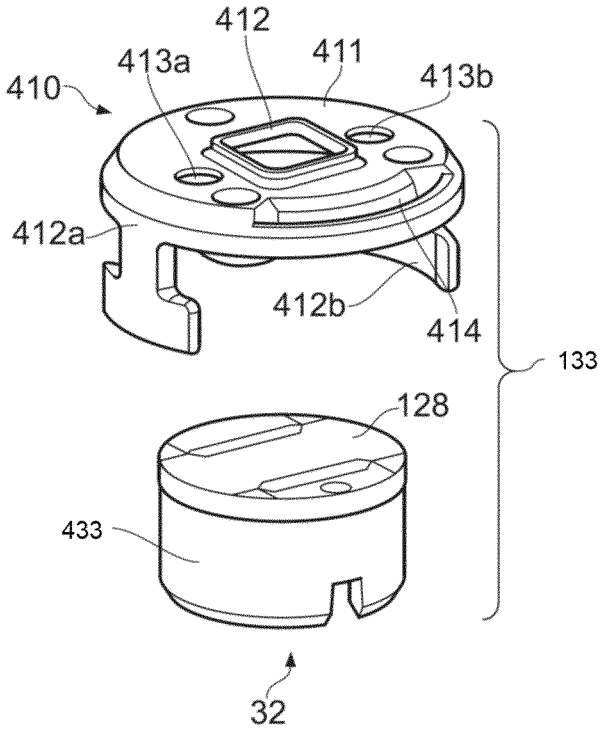
FIG. 8 shows exploded perspective view of a heater assembly.
Figure 9:
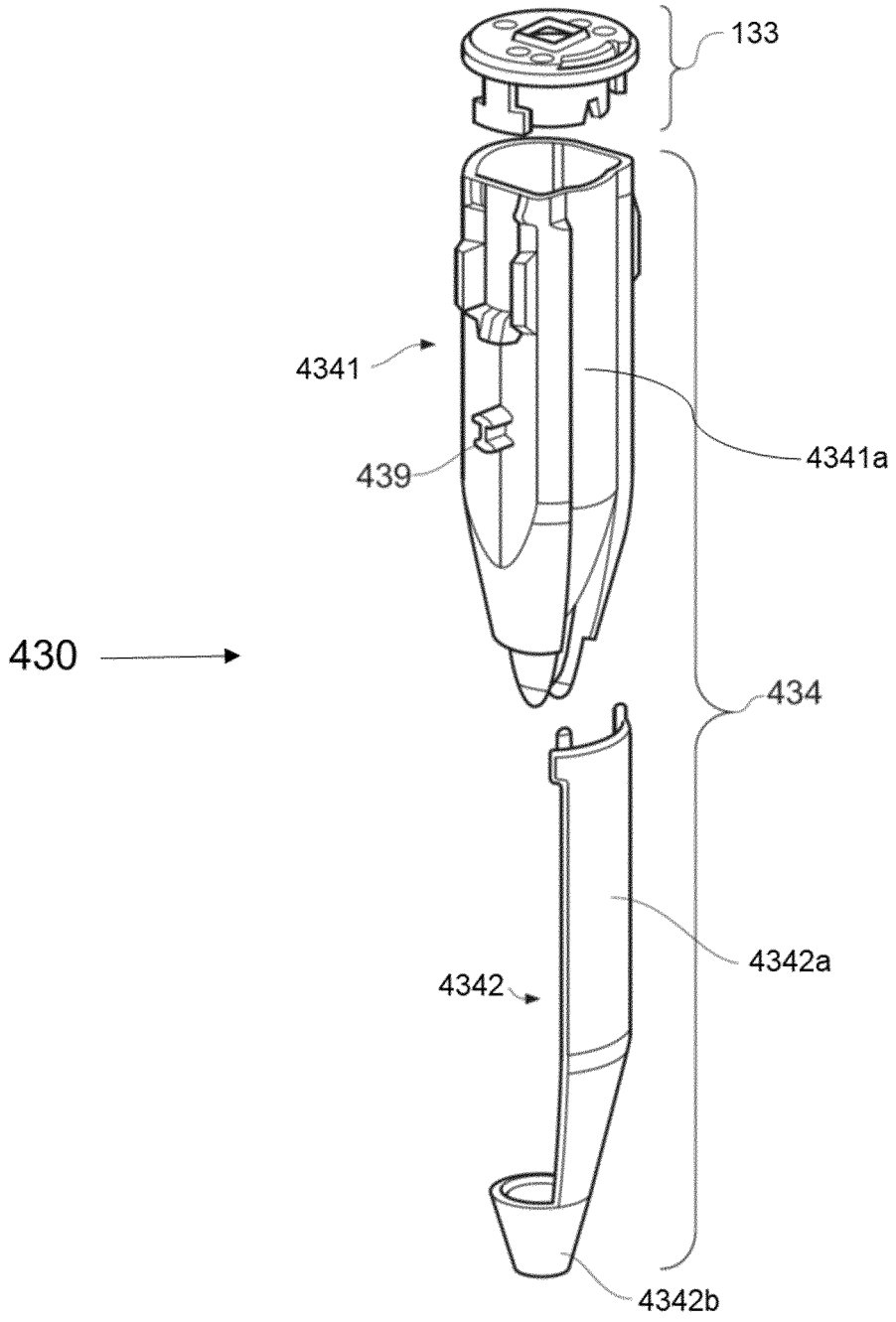
FIG. 9 shows exploded perspective view of a cartridge main body and a heater assembly.
Figure 10A:
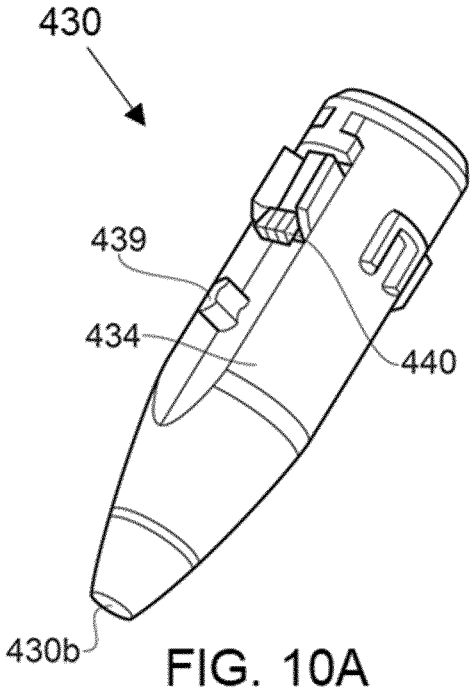
FIGS. 10A to 10D show various perspective views of the cartridge of FIG. 7.
Figure 10B:
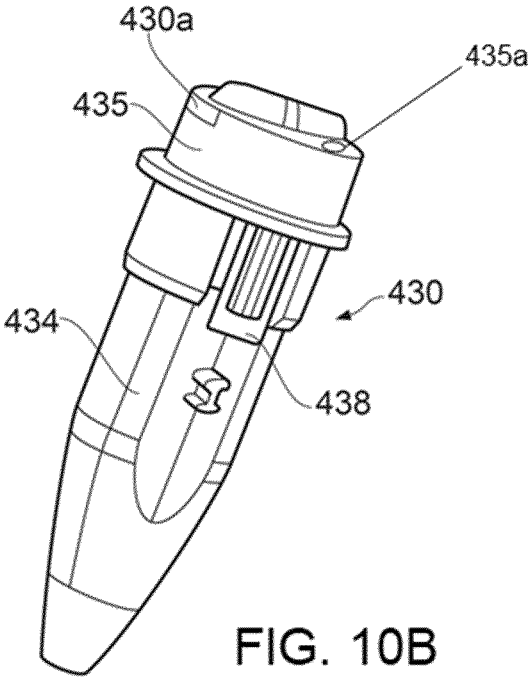
Figure 10C:
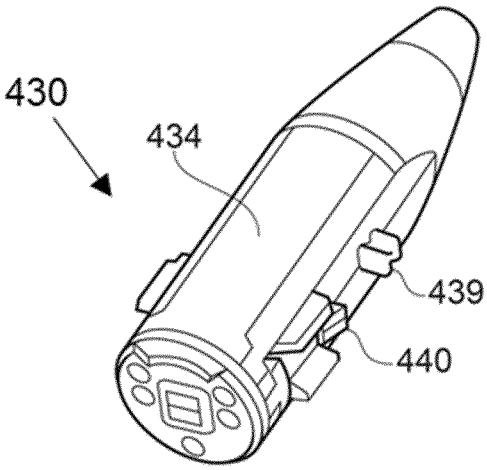
Figure 10D:
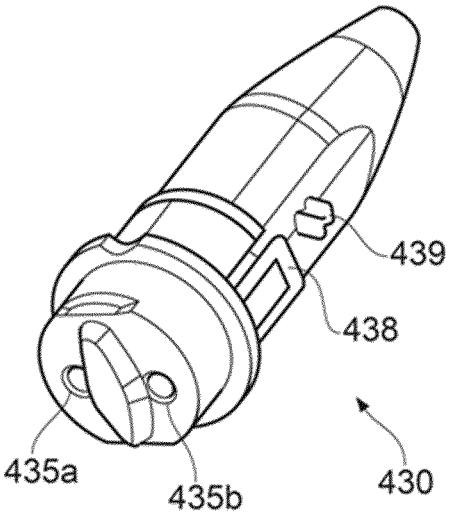

As best seen in FIG. 8, the heater assembly 133 further comprises a heater assembly cover 410 which extends around and over the heating element 128 and heater assembly base 433. The heater assembly cover 410 comprises a disc-like cover portion 411 arranged to overlie the heating element 128. The cover portion 411 comprises a first, square shaped aperture 412 arranged to overlie a central portion of the heating element 128. The cover portion 411 also comprises a pair of circular shaped apertures 413*a*, 413*b* arranged to overlie respective end portions of the heating element 128. The cover portion further comprises an arcuate shaped aperture 414 arranged around a portion of the circumferential periphery of the cover portion 411.

The pair of circular shaped apertures 413*a*, 413*b* are arranged to facilitate electrical connection between the end portions of the heating element 128 and respective contact elements 45 on an aerosol-generating device 40. The first, square shaped aperture 412 is arranged to allow aerosol-forming substrate which is vaporised by the heating element 128 to be entrained in an airflow through the cartridge 430. The arcuate shaped aperture 414 positioned so that it does not overlie the heating element 128 and heater assembly base 433, but instead resides in a portion of the cover portion 411 which extends radially beyond the heating element 128 and heater assembly base 433. The arcuate shaped aperture 414 provides an aperture through which aerosol-forming substrate which is vaporised by the heating element 128 can pass through on its way to the user.

The heater assembly cover 410 also comprises a pair of connecting arms 412*a*, 412*b* extending from the cover piece 411 along the side of the heater assembly base 433. The connecting arms 412*a*, 412*b* are configured to form a snap fit engagement with a device end of the main body 434 of the cartridge 430. This may allow a tight seal to be formed between the main body of the cartridge and the heater assembly. This may help to ensure that aerosol-forming substrate is only able to exit the storage container 424 in the cartridge main body 434 via the first, square shaped aperture 412.

The main body 434 of the cartridge 430 may also be referred to as the cartridge main body 434. As best seen from FIG. 9, the cartridge main body 434 comprises two parts; a first part 4341 defining a storage container 424 for holding the liquid aerosol-forming substrate, and a second part 4342 configured to connect to the first part. The first part 4341 of the cartridge main body 434 is generally hollow and elongated, and has a first, open end onto which the heater assembly 133 is fitted. When in use, the first open end is oriented towards the aerosol generating device 40. The second end of the first part 4341 of the cartridge main body 434 is closed, so that a reservoir of liquid aerosol-forming substrate can be contained within the first part 4341 of the cartridge main body 434.

The first and second parts 4341, 4342, of the cartridge main body 434 collectively define at least a portion of an airflow path in the cartridge. More specifically, the second part 4342 of the cartridge main body 434 comprises a side cover portion 4342*a* arranged to extend along a side 4341*a*, which may be a recessed side, of the first part of the cartridge main body 434 to define a side airflow channel. The side airflow channel is defined between the inner surface of the side cover portion 4342*a* and the outer surface of the side 4341*a* of the first part of the cartridge main body 434.

The second part 4342 of the cartridge main body 434 also comprises a nozzle portion 4342*b* arranged to fit over the second, closed end of the first part 4341 of the cartridge main body 434. The nozzle 4342*b* defines a cartridge air outlet 430*b*, and is connected to one end of the side cover portion 4342*a*. The other end of the side cover portion 4342*a* is arranged to connect to the portion of the heater assembly cover 410 which contains the arcuate shaped aperture 414.

Therefore, when the heater assembly 133 and the first and second parts 4341, 4342 of the cartridge main body are all connected to one another, the cartridge 430 defines an airflow path extending from the arcuate shaped aperture 414, along the side airflow channel to the cartridge air outlet 430*b* defined by the nozzle 4342*b*.

FIGS. 10A to 10D, show different perspective views of the cartridge 430 with and without the cartridge cap 435. The cartridge cap 435 is configured to connect to the cartridge main body 434, and cover the fluid-permeable heating element 128. In particular, the cartridge cap 435 comprises a top portion 436, which completely overlies the disc-like cover portion 411 of the heater assembly cover 410, and a side wall 437 extends over part of the side wall of the cartridge main body 434. The top of the cartridge cap 435 comprises a pair of circular shaped apertures 435*a*, 435*b* arranged to overlie the pair of circular shaped apertures 413*a*, 413*b* of the heater assembly. This allows respective contact elements 45 on an aerosol-generating device 40 to pass through the cartridge cap 435 and heater assembly cover 410 and form an electrical connection with the heating element 128. The side wall of the cartridge cap 435 comprises at least one cartridge air inlet 430*a*.

The cartridge cap side wall also comprises a deflectable member 438. The cartridge cap connects to the cartridge main body 434 via an engagement between the deflectable member 438 and an engagement protrusion 440 disposed on the upper portion of the side wall of the first part of the cartridge main body 434. In particular, the deflectable member 438 has a hole or notch into which the engagement protrusion 440 extends when the cartridge cap 435 is fitted over the cartridge main body 434. This engagement locks the cartridge cap 435 in place with respect to the cartridge main body, in a position in which air is blocked from flowing from the cartridge air inlet 430*a* to the heating element 128.

Figure 11A:
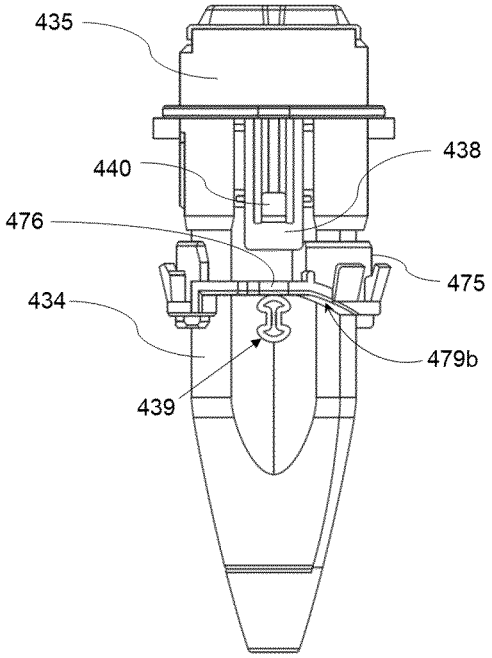
FIG. 11A shows a view of the cartridge assembly of the first embodiment in a first position.
Figure 11B:
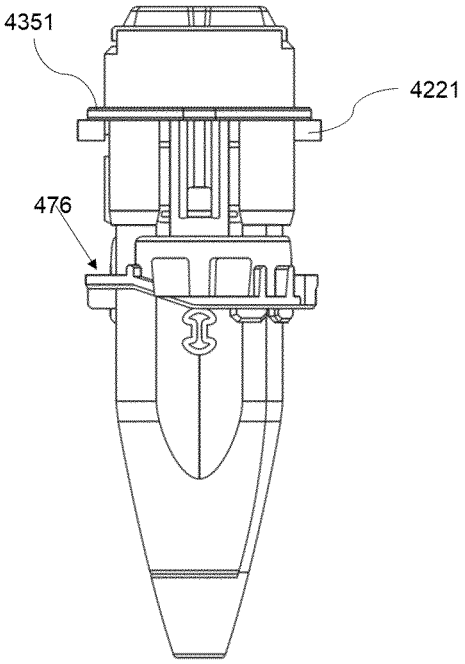
FIG. 11B shows a view of the cartridge assembly of the first embodiment in a second position.
Figure 12A:
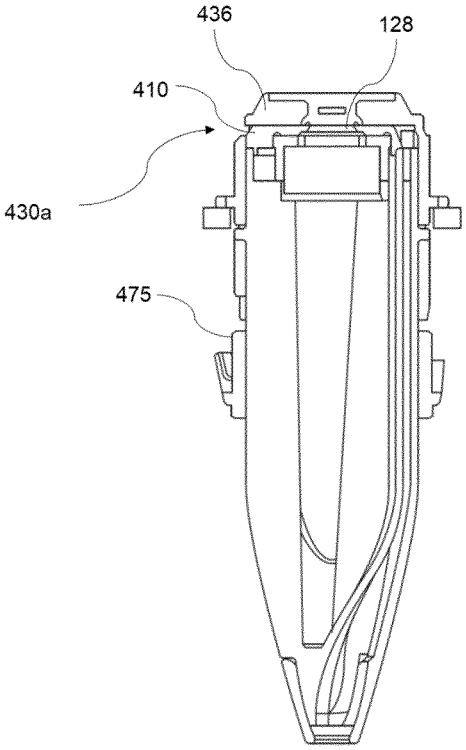
FIGS. 12A and 12B show sectional views of the cartridge assembly of FIGS. 11A and 11B.
Figure 12B:
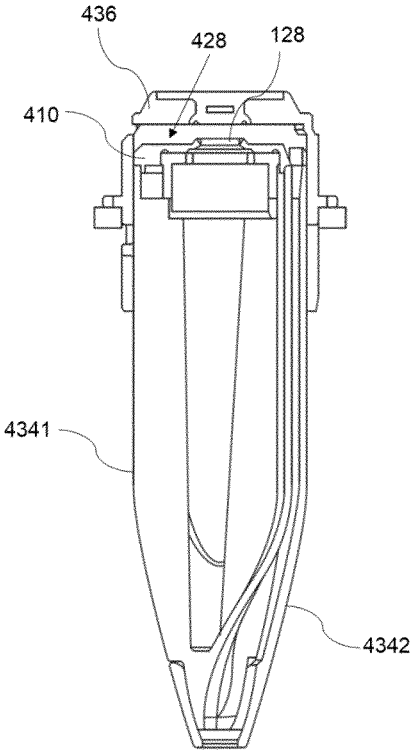

Reference should now be made to FIGS. 11A and 11B. FIG. 11A shows the cartridge 430 when inserted into the housing, with the cartridge cap 435 being disposed in the first position. FIG. 11B shows the cartridge 430 when disposed in the housing, with the cartridge cap 435 being disposed in the second position. For clarity purposes, the outer housing 422 has not been shown, only insert member 470 is visible.

With reference to FIGS. 11A and 11B, when the cartridge 430 is inserted into the housing 431, the cartridge cap 435 is configured to move with respect to the cartridge main body 434 between: a first position, in which air from the outer housing air inlet 422*a* is blocked from flowing to the outer housing air outlet 422*b*, via the cartridge air inlet 430*a*, the fluid-permeable heating element 128, and the cartridge air outlet 430*b*; and a second position, in which an airflow path exists from the housing air inlet to the housing air outlet, via the cartridge air inlet 430*a*, the fluid-permeable heating element 128, and the cartridge air outlet 430*b*. In particular, when the cartridge 430 is first inserted into the cartridge housing 431, the geometry of the cartridge and housing cause the guide protrusion 439 of the cartridge to become aligned with the receiving portion 476 of the insert member 470 (see FIG. 11A). This means that as the cartridge moves further into the housing 431, the guide protrusion 439 can pass through the space defined by the receiving portion 476 of the insert member 470 and into the guide track. Once the guide protrusion 439 has passed into the guide track, a non-inclined portion 429*a* of the guide surface of the housing 431 prevents further movement of the cartridge 430 into the housing 431. However, at this point, the geometry of the cartridge and housing permit rotational movement of the cartridge 430 relative to the housing 431. Such rotation results in the guide protrusion 439 moving along the guide track until it engages with an inclined portion 479*b* of the insert member 470. In this position, the deflectable member 438 of the cartridge cap 435 has just started to engage with the rim 475 of the insert member 470.

Further rotational movement of the cartridge 430 relative to the housing 431 from this position has two consequences. Firstly, the inclined portion 479*b* of the insert member 470 engages with the guide protrusion 439 and causes the cartridge main body 434 to be pushed further into the housing 431. This is permissible because the corresponding portion 429*b* of the guide surface of the housing 431 is also inclined, and thus does not oppose such further movement of the cartridge main body 434 into the housing.

The second consequence is that the rim 475 of the insert member 470 fully engages with the distal end of the deflectable member 438 and causes the deflectable member 438 to be lifted off and away from the engagement protrusion 440 (see FIG. 11B). This disconnects the cartridge cap 435 from the cartridge main body 434. Furthermore, the engagement of a flange 4351 on the cartridge cap 435 with a corresponding flange 4221 on the housing means that the cartridge cap cannot move further into the housing 431. The cartridge cap 435 is therefore retained in place relative to the housing 431 as the cartridge main body 434 moves further into the housing 431. Such partial separation of the cartridge cap 435 and the cartridge main body 434 means that a space or chamber 428 is created in the cartridge 430 above the heating element 128. This space or chamber 428 is best seen from FIG. 12B, which shows a sectional view of the cartridge of FIG. 11B.

The provision of this chamber means that an unimpeded air flow path can exist in the cartridge 430. The airflow path extends from the cartridge air inlet 430*a*, across the top of the heating element 128, through the arcuate aperture 414, along the side airflow channel, all the way to the cartridge air outlet 430*b* of the nozzle portion 4342*b*. In this open position, a user can therefore draw on the mouth end of the outer housing 422 to receive aerosol from the cartridge 430.

When a user has finished using the cartridge 430, the user can rotate the cartridge in the opposite direction to that which they used to open the cartridge. For example, if a clockwise rotation was used to open the cartridge 430, then a counter clockwise rotation can be used to close the cartridge. When rotating in such an opposite direction, the inclined portion 429*b* of the housing 431 engages with the guide protrusion 439 and causes the cartridge main body 434 to be pushed away from the housing 431. The cartridge cap 435 remains fixed in position relative to the housing 431 by virtue of a connected aerosol generating device 40. Once the rotation causes the assembly to approach the position shown in FIG. 11A, the deflectable member 438 begins to disengage from the rim 475 of the insert member 470, and re-engage with the engagement protrusion 440 of the cartridge main body 434. The cartridge cap 435 and cartridge main body 434 therefore reconnect to one another, and thereby close over the space above the heating element 128. This forms a sealed engagement, whereby air cannot flow from the cartridge air inlet 430*a* to the heating element 128. Such a sealed engagement is best seen from FIG. 12A, which shows a sectional view of the cartridge of FIG. 11A. This sealed engagement can prevent liquid from leaking out of the cartridge 430 via the heating element 128 and cartridge air inlet 430*a*. In particular, as can be seen from FIG. 12A, when the cartridge cap is in the first position, the heater assembly cover 410 is aligned with the cartridge air inlet 430*a*, such that the heater assembly cover 410 occludes the cartridge air inlet 430*a* and blocks air from flowing into the cartridge assembly via the cartridge air inlet 430*a*. In this first position, the upper surface of the heater assembly cover 410 also abuts the lower surface of the top portion 436 of the cartridge cap 435. This provides a sealed engagement to prevent air from flowing from the cartridge air inlet 430*a* to the heating element 128.

The cartridge 430 may then be further rotated relative to the housing 431, until the guide protrusion 439 of the cartridge 430 becomes aligned with the receiving portion 476 of the insert member 470. In this rotational position, the cartridge 430 can then be removed from the housing, with the cartridge 430 being removed in its closed state.

For clarity, the features of the insert member 470, cartridge 430 and outer housing 422 of the new design have been described above with reference to a single guide track, single rim, single guide protrusion, single engagement protrusion, single deflectable member, and so forth. However, as will be appreciated from the Figures, the insert member 470, the cartridge 430 and the outer housing 422 may, in some embodiments, actually comprise two of each of these features, located diametrically opposed to one another. This may advantageously provide a balanced arrangement, which may help to improve the reliability of the cartridge assembly as a whole.

In the embodiment described above with respect to the drawings, the ability to move the cartridge cap from a first position to a second position, such that air flow to the heating element can be selectively blocked or opened, means that leakage of liquid aerosol-forming substrate from the heating element to the exterior of the cartridge assembly, can be reduced. This means that when the cartridge assembly is not being used to produce an aerosol, a consumer can be more confident that there will not be any leakage of any liquid aerosol-forming substrate. However, when the consumer is ready to use the aerosol-generating system, they can readily move the cartridge cap, so that the heating element is exposed to airflow, and consequently able to produce aerosol that can be released to the consumer.

The invention claimed is:

1. A cartridge for an aerosol-generating system, the cartridge comprising:

a cartridge main body comprising at least one cartridge air outlet;

a storage container within the cartridge main body, the storage container containing a supply of liquid aerosol-forming substrate;

a heating element disposed at a first end of the cartridge main body, the heating element being in fluid communication with the storage container; and a cartridge cap comprising:

at least one cartridge air inlet, a top portion configured to cover the first end of the cartridge main body and the heating element, and a side portion extending from the top portion of the cartridge cap and over a part of a side portion of the cartridge main body, wherein the cartridge cap side portion comprises an engagement portion comprising a deflectable member configured to releaseably engage with a corresponding protrusion on a side wall of the cartridge main body, wherein the deflectable member extends directly from the top portion of the cartridge cap, and wherein, when the engagement portion is disengaged from the cartridge main body, the cartridge cap is configured to move relative to the cartridge main body between:

a first position, in which one or both of the cartridge cap and the cartridge main body block air from flowing from the cartridge air inlet to the cartridge air outlet, via the heating element, and a second position, in which an airflow path exists from the cartridge air inlet to the cartridge air outlet, via the heating element.

2. The cartridge according to claim 1, wherein the deflectable member comprises a distal end, which extends towards a second end of the cartridge main body, and a proximal end directly attached to the top portion of the cartridge cap, the second end of the cartridge main body being opposed to the first end of the cartridge main body.

3. The cartridge according to claim 1, wherein the deflectable member comprises a hole or notch into which the corresponding protrusion extends when the cartridge cap is in the first position.

4. The cartridge according to claim 1, wherein the top portion of the cartridge cap comprises a pair of apertures arranged to overlie the heating element.

5. The cartridge according to claim 1, wherein the heating element forms part of a heater assembly of the cartridge, the heater assembly comprising:

a heater assembly base supporting the heating element, and a heater assembly cover overlying the heater assembly base and the heating element, and wherein the heater assembly cover underlies the cartridge cap.

6. The cartridge according to claim 5, wherein the heater assembly cover comprises one or more of:

a first aperture overlying a central portion of the heating element, a pair of second apertures, each overlying an end portion of the heating element, and a third aperture positioned in a peripheral region of the heater assembly cover and not overlying the heating element.

7. The cartridge according to claim 5, wherein the cartridge main body further comprises two parts: a first part defining the storage container, and a second part configured to connect to the first part, so that the first and the second parts of the cartridge main body collectively define at least a portion of the airflow path in the cartridge.

8. The cartridge according to claim 7, wherein the second part of the cartridge main body comprises a side cover portion arranged to extend along a side of the first part of the cartridge main body to define a side airflow channel, the side airflow channel being defined between an inner surface of the side cover portion and an outer surface of the first part of the cartridge main body, the side airflow channel forming part of the airflow path in the cartridge.

9. The cartridge according to claim 8, wherein the second part of the cartridge main body further comprises a nozzle portion attached to one end of the side cover portion, the nozzle portion defining the cartridge air outlet.

10. The cartridge according to claim 8, wherein the heater assembly cover comprises one or more of:

a first aperture overlying a central portion of the heating element, a pair of second apertures, each overlying an end portion of the heating element, and a third aperture positioned in a peripheral region of the heater assembly cover and not overlying the heating element, and wherein the third aperture of the heater assembly cover is disposed at one end of the side airflow channel.

11. A cartridge assembly for an aerosol-generating system, the cartridge assembly comprising:

a cartridge according to claim 1; and a housing having a mouth end and an opposed device end configured to connect to an aerosol-generating device, wherein at least one housing air outlet is provided at the mouth end of the housing, and at least one housing air inlet is provided upstream of the housing air outlet, wherein, when the cartridge is disposed within the housing, the cartridge cap is configured to move relative to the cartridge main body between:

a first position, in which one or both of the cartridge cap and the cartridge main body block air from flowing from the cartridge air inlet to the cartridge air outlet, via the heating element, and a second position, in which an airflow path exists from the housing air inlet to the housing air outlet, via the cartridge air inlet, the heating element, and the cartridge air outlet.

12. The cartridge assembly according to claim 11, wherein when the cartridge is received in the housing, the cartridge and the housing are arranged to engage with one another such that rotational movement of the cartridge with respect to the housing causes longitudinal movement of the cartridge cap with respect to the cartridge main body, with the longitudinal movement corresponding to movement of the cartridge cap relative to the cartridge main body between the first position and the second position.

13. The cartridge assembly according to claim 12, wherein the cartridge main body further comprises at least one guide protrusion, and wherein the housing defines a guide track for the at least one guide protrusion.

14. The cartridge assembly according to claim 13, wherein movement of the guide protrusion along the guide track of the housing is configured to cause movement of the cartridge cap with respect to the cartridge main body between a first attached position and a second partially attached position.

15. The cartridge assembly according to claim 11, wherein the housing further comprises a rim disposed within the housing, the rim being configured to engage with the deflectable member of the cartridge main body as the cartridge is rotated within the housing, and wherein, when the rim engages with the deflectable member, the deflectable member disengages from an engagement protrusion of the cartridge main body.

* * * * *